US005868129A

United States Patent [19]

Christianson

[11] Patent Number: 5,868,129

[45] Date of Patent: Feb. 9, 1999

[54] SNORKEL WITH PUMP

[76] Inventor: Tony Christianson, 2007 Wawona Station, Yosemite, Calif. 95389

[21] Appl. No.: 807,281

[22] Filed: Feb. 27, 1997

[51] Int. Cl.[6] ..... A62B 7/62

[52] U.S. Cl. ..... 128/201.11; 128/201.27

[58] Field of Search ..... 128/201.11, 201.27, 128/200.25, 200.23, 200.29, 201.19, 201.28

[56] References Cited

U.S. PATENT DOCUMENTS

| | | | |
|---|---|---|---|
| 4,708,135 | 11/1987 | Arkema | 128/201.11 |
| 5,193,530 | 3/1993 | Gamow et al. | 128/201.27 |
| 5,438,977 | 8/1995 | Gomez et al. | 128/201.27 |
| 5,487,379 | 1/1996 | Koshiishi | 128/201.27 |
| 5,535,734 | 7/1996 | Lu et al. | 128/201.11 |
| 5,671,728 | 9/1997 | Winefordner et al. | 128/201.11 |

FOREIGN PATENT DOCUMENTS

| | | | |
|---|---|---|---|
| 849903 | 8/1939 | France | 128/201.11 |
| 868058 | 2/1953 | Germany | 128/201.11 |

*Primary Examiner*—John G. Weiss

[57] ABSTRACT

The instant invention is a skin diving snorkel having a conduit with an open end above the water surface, and an underwater end which terminates in a collapsible chamber. A mouthpiece adjacent and above the chamber provides a flow path between the conduit and the interior of the diver's mouth. A check valve in the opening between the conduit and the chamber allows water to flow from the conduit into the chamber, but not in the reverse direction. The chamber also has a purge valve which allows water in the chamber to flow to ambient. When the hydrostatic pressure within the snorkel is greater than ambient, water will flow sequentially through the check valve, chamber and purge valve to ambient. Consequently, water in the snorkel which extends above the ambient water surface will ultimately drain through the purge valve, decreasing the amount of water remaining within the snorkel to be purged. The chamber volume and double valve arrangement inhibit the flow of air through the purge valve during a purging exhalation, minimizing the wasteful loss of purging air. The chamber can be manually or mechanically collapsed, which reduces the chamber's internal volume. Collapsing the chamber will force air or water within to flow out the purge valve. When the collapsing force is removed, a spring, or alternately, the resilient construction of the chamber itself, will cause the chamber to expand back to its original internal volume. The expanding chamber will pull water from the conduit through the check valve into the chamber. Alternately collapsing and expanding the chamber will pump water from the conduit to ambient without resorting to an explosive exhalation.

4 Claims, 5 Drawing Sheets

10
14
12
16
22
18
30

14
12
16
22
3
24
3
20
18
30
26
28

12
24

12
22
14
24
20
18
12

30
26
16
12
22
22

24
20
18a
24
30
18
34
20
32
30

SNORKEL WITH PUMP

BACKGROUND OF THE INVENTION

1. Field of the Invention

The present invention is generally related to snorkels used by skin divers. More particularly, this invention is concerned with purging water from a flooded snorkel.

2. Description of the Prior Art

Skin divers use the snorkel as a means to breathe while swimming face down the water surface. The snorkel functions as a conduit between the diver's mouth and the overhead air. Typically, when in use, the open end of the snorkel conduit extends a short distance above the water surface. Occasionally, due to swimming movements or wave action, small amounts of water flow into the open end of the snorkel and partially flood the conduit. Also, water will flood the snorkel when the diver swims or dives below the water surface. An experienced skin diver can sense when water enters the snorkel and responds by immediately stopping inhalation. Respiration is resumed after the snorkel has been purged of water.

Inexperienced skin divers find occasional flooding especially troublesome because, undetected, water can be inhaled resulting in coughing and extreme discomfort. Consequently, several configurations have been proposed to restrict or block the normally open end of the snorkel and thereby prevent water from entering.

U.S. Pat. No. 2,317,236 entitled Breathing Apparatus for Swimmers, issued to C. H. Wilen, et al, on Apr. 20, 1943, teaches a valve with a buoyant ball arranged to block the above water end of the snorkel whenever water starts to enter. Such valves are bulky, often fail to seal, and, also, significantly increase respiratory effort. Although once popular, such devices are now considered unreliable and obsolete.

A recent invention functionally similar to the snorkel of Wilen, U.S. Pat. No. 5,117,817 entitled Vertical Co-Axial Multi-Tubular Diving Snorkel, issued to Hsin-Nan Lin on Jun. 2, 1992 teaches an annular float arrangement which blocks the above water end of the snorkel whenever water starts to enter. To assist in purging, the Lin snorkel also incorporates a secondary purge tube within the breathing conduit. The Hsin-Nan Lin snorkel suffers from the same problems as the Wilen snorkel.

U.S. Pat. No. 4,071,024 entitled Snorkel, issued to Max A. Blanc on Jan. 31, 1978, teaches an air entrapping cap which is mounted on the above water opening of the snorkel. A tortuous passage in the cap retards water flow into the snorkel. Although such a cap is somewhat effective in blocking the occasional flow of surface water into the snorkel, it also retards expulsion of water which enters the snorkel during a dive or swim below the water surface. The significant increase in respiratory and purging effort limits its utility and subsequent popularity.

Similar to Blanc, U.S. Pat. No. 5,199,422 entitled Modular Snorkel, issued to Stan Rasocha on Apr. 6, 1993, teaches an exhaust valve mounted on a cap which covers the upper end of the snorkel. The cap restricts the entry of splashed water into the snorkel. The exhaust valve on the cap permits the expulsion of water from within the snorkel during a purging exhalation. Rasocha's snorkel increases respiratory effort and does not noticeably reduce purging effort.

The open snorkel conduit will be completely flooded with water when a skin diver returns to the surface after swimming or diving underwater. The open end of the snorkel is above the water when the skin diver swims face down on the water surface. With the open end of the snorkel above the water, the conduit is purged for respiration by exhaling an explosive blast of air into the mouthpiece.

Surface tension forms the purging blast of air into a bubble which spans the cross section of the conduit. Pressure within the bubble expands the bubble toward the open end of the snorkel conduit. As the leading surface of the bubble moves away from the mouthpiece, the bulk of the water within the conduit is pushed ahead of the bubble and out the open end.

The purging bubble of air will slip past water which adheres to the inside surface of the conduit. After the purging air bubble is spent, residual water will flow down the inside surface toward the mouthpiece. Also, water which splashes into the open end of the snorkel conduit due to swimming movements or wave action will typically strike and adhere to the inside surface of the conduit and thereafter flow toward the mouthpiece. Water accumulates at the lowermost portion of the snorkel conduit, typically adjacent the mouthpiece, and soon obstructs the conduit. Unless the conduit is completely blocked, a slow and cautious inhalation is possible after which another purging exhalation can be made.

The respiratory effort needed to purge a snorkel is significant. Many skin divers lack the respiratory strength needed to completely purge a flooded snorkel with a single exhalation, and must repeat the purging procedure several times. Also, water will sometimes enter the snorkel just as the diver has completed an exhalation, leaving very little air in the lungs to satisfactorily complete a purge. Consequently, a means which decreases the respiratory effort and the amount of air required to purge a snorkel will be very beneficial.

A popular solution places an externally directed purge valve in the wall of the snorkel conduit at a location near the snorkel mouthpiece. Water in the flooded conduit which extends above the ambient water surface will drain through the purge valve. Because the total volume of water in the flooded snorkel is reduced by water flow through the purge valve, the respiratory effort required to purge the remaining water is also reduced.

Unfortunately, a purge valve also provides an alternate path for forcefully exhaled air. A purge valve located close to the mouthpiece will quickly and wastefully dissipate the explosive blast of purging air. One solution to this problem places the purge valve at a location approximately midway between the mouth opening and the open end of the snorkel conduit.

At mid-length of the snorkel conduit, the purge valve will be close to the ambient water surface when the skin diver is swimming face down on the water surface. At such a location, the purge valve will drain that portion of the snorkel conduit which extends above the water surface, but will not initially interfere with the purging blast of air. Even at this location, the purge valve will dissipate the forcefully exhaled air and the amount of residual water adhering to the inner surface of the conduit between the purge valve and the open end will be substantial. The residual water subsequently accumulates at the lowermost portion of the snorkel conduit and obstructs the conduit. Consequently, the purge valve by itself, even when located mid-length of the snorkel conduit, is of limited benefit.

U.S. Pat. No. 4,278,080 entitled Diving Snorkel, issued to Joseph N. Schuch on Jul. 14, 1981, teaches a purge valve located at the bottom of a branch conduit which joins the snorkel conduit at a location approximately midway between the mouthpiece and the open end. The purge valve drains the snorkel conduit until the water level within the conduit matches the ambient water level. Part of the purging air will divert into the branch conduit and force water within the branch conduit out the purge valve. Schuch teaches that the branch conduit must have sufficient length to provide the transient resistance necessary to allow purging of the snorkel conduit before the purging air reaches and is dissipated by the purge valve.

Water within the snorkel conduit of Schuch is pushed out the open end before the purging air clears the branch conduit of water and reaches the purge valve. Nevertheless, diverting part of the purging bubble of air into a branch conduit abates the driving pressure within the purging bubble and allows significant residual water to adhere to the upper portion of the snorkel conduit. Consequently, although the snorkel configuration of Schuch somewhat reduces the effort required to purge a flooded snorkel, it does not decrease the amount of purging air required, and it does not reduce residual water which adheres to the snorkel conduit wall and soon flows down the wall to obstruct the snorkel conduit near the mouthpiece. Also, the branch conduit adds significantly to the size of the snorkel, making the snorkel unwieldy in use.

As another approach, U.S. Pat. No. 5,143,059 entitled Water Trap for a Snorkel, issued to John Delphia on Sep. 1, 1992, teaches a water trap adjacent a purge valve located approximately mid-length on the snorkel. Water flowing within the snorkel is deflected and retained until discharged through the exhaust valve. The trap means of Delphia is a complex combination of baffles, lips and openings which inherently restrict respiratory flow and require relatively complex tooling for manufacturing.

In view of the foregoing factors, conduits and problems which are characteristic of the prior art, the applicant has invented and patented several improved snorkels.

The first improved snorkel is taught by the applicant's application Ser. No. 107,987 filed Oct. 13, 1987 now U.S. Pat. No. 4,879,995 which issued Nov. 14, 1989. The improved snorkel includes a conduit whose length is divided by a chamber located above the water surface when the snorkel is in the approximate position of use by a skin diver swimming face down on the water surface. A flared transition from the inside cross section of the upper conduit to the larger inside cross section of the chamber is smooth and continuous. A chamber purge valve initially drains the chamber and upper conduit of water when the skin diver returns to the surface after swimming or diving underwater. The lower conduit is purged for respiration by exhaling a forceful blast of air into the mouthpiece which pushes the water upward. The effort required to purge the improved snorkel is reduced because the bulk of the ascending water flows out the chamber purge valve, without the need to overflow the snorkel top. After a purging procedure, or after splashing into the open end of the upper conduit due to swimming movements or wave action or the like, the forces of molecular cohesion and adhesion cause water to flow down the inside surface of the upper conduit and chamber to the chamber purge valve. The purge valve opens under slight hydrostatic pressure and drains the water to ambient at a rate sufficient to prevent overflow into the lower conduit. In an alternate configuration, taught by the applicant's application Ser. No. 420,278 filed Oct. 12, 1989 now U.S. Pat. No. 5,092,324 which issued Mar. 3, 1992, initial drainage is facilitated by a second purge valve located at the bottom of a second chamber below the mouthpiece. The second chamber also serves to capture drainage from the mouthpiece and water which overflows from the upper conduit.

A third improved snorkel is taught by the applicant's application Ser. No. 292,224 filed Dec. 30, 1988 now U.S. Pat. No. 4,872,453 which issued Oct. 10, 1989. The improved snorkel features a chamber that intersects the conduit at a location that is at approximately mid-length. The chamber houses a float member. When water fills the snorkel, the float member is buoyed out of the chamber into the conduit and blocks upward flow therein. The flooded snorkel is purged by exhaling into the mouthpiece. Because the float member blocks upward flow when the conduit is flooded, the upwardly expanding exhaled air is trapped beneath the float member. The trapped air displaces the water in the conduit, forcing the water down and out the purge valve. As a consequence, the effort and amount of air required to purge the Christianson snorkel are significantly reduced.

A fourth improved snorkel is taught by the applicant's application Ser. No. 292,225 filed Dec. 30, 1988 now U.S. Pat. No. 4,877,022 which issued Oct. 31, 1989. The improved skin diving snorkel has a conduit with an unobstructed, open end above water and an underwater end which terminates in a chamber. The chamber houses a normally closed float valve in series with an outwardly directed purge valve. The purge valve allows water in the snorkel to flow to ambient when hydrostatic pressure within the snorkel is greater than ambient. The chamber also serves to accumulate water which drains down the conduit after a purging exhalation or after splashing in the open end. A mouthpiece adjacent and above the chamber provides a flow path from the conduit to the interior of the diver's mouth. The float valve opens when the chamber is flooded with water. Consequently, water in the snorkel which extends above the ambient water surface will drain through the purge valve, decreasing the amount of water remaining within the snorkel to be purged. The float valve blocks flow through the purge valve when the chamber is emptied of water during a purging exhalation, preventing the wasteful loss of purging air. Water which accumulates in the chamber between purges is eliminated when the snorkel is next purged.

The instant invention is yet another improved snorkel. The instant snorkel provides a means to pump residual water from the interior of the snorkel without the need for a purging exhalation. In addition, the pump hinders the wasteful loss of purging air through the purge valve.

SUMMARY OF THE INVENTION

The instant invention is a skin diving snorkel having a conduit with an open end above the water surface, and an underwater end which terminates in a collapsible chamber. A mouthpiece adjacent and above the chamber provides a flow path between the conduit and the interior of the diver's mouth. A check valve in the opening between the conduit and the chamber allows water to flow from the conduit into the chamber, but not in the reverse direction. The chamber also has a purge valve which allows water in the chamber to flow to ambient. When hydrostatic pressure within the snorkel is greater than ambient, water will flow sequentially through the check valve, chamber and purge valve to ambient. Consequently, water in the snorkel which extends above the ambient water surface will ultimately drain through the purge valve, decreasing the amount of water remaining within the snorkel to be purged. The chamber volume and double valve arrangement inhibit the flow of air through the purge valve during a purging exhalation, minimizing the wasteful loss of purging air. The chamber can be manually or mechanically collapsed, which reduces the chamber's internal volume. Collapsing the chamber will force air or water within to flow out the purge valve. When the collapsing force is removed, a spring, or alternately, the resilient construction of the chamber itself, will cause the chamber to expand back to its original internal volume. The expanding chamber will pull water from the conduit through the check valve into the chamber. Alternately collapsing and expanding the chamber will pump water from the conduit to ambient without resorting to an explosive exhalation.

DESCRIPTION OF THE DRAWINGS

A detailed description of the invention is made with reference to the accompanying drawings wherein like numerals designate corresponding parts in the several Figures.

DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention.

Figures 1, 2, 3:
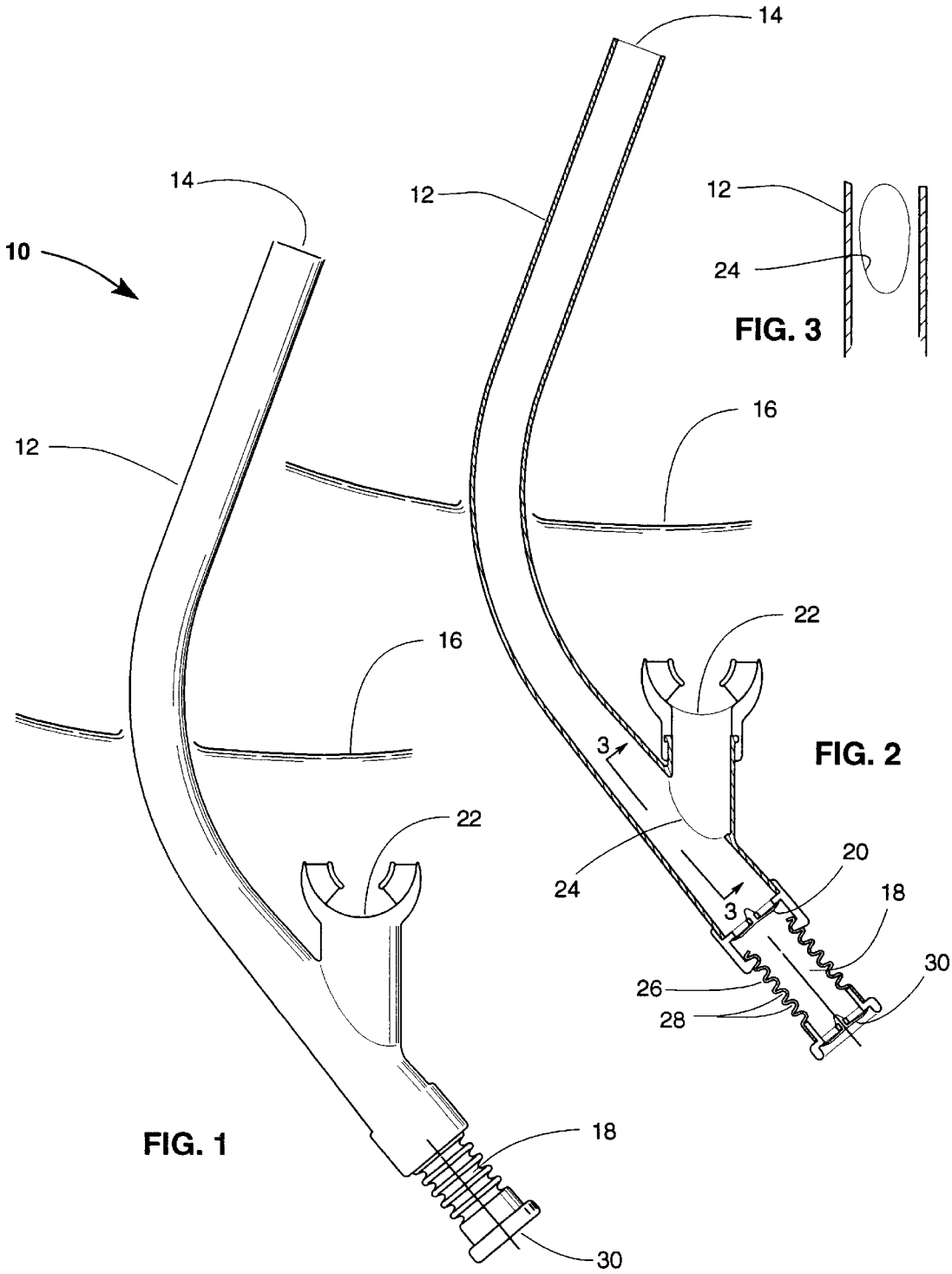
FIG. 1 is a front elevation view of a snorkel which has been constructed in accordance with the principles of the instant invention, and which is pictured in the approximate position of use by a skin diver swimming face down on the water surface.
FIG. 2 is a longitudinal sectional view of the snorkel of FIG. 1, shown during respiration.
FIG. 3 is a partial sectional view of the snorkel of FIG. 2, taken along a plane corresponding to line 3—3 of FIG. 2.

Referring to FIGS. 1 and 2, snorkel 10 is pictured in the approximate position of use by a skin diver swimming face down on the water surface. (For clarity, the diver is not pictured in the FIGS.) Snorkel 10 includes conduit 12 having an upper end with opening 14. Conduit 12 is constructed of a rigid or semi-rigid material, for example, vinyl plastic or the like. The upper end of conduit 12 extends into the air above ambient water surface 16. Air and water can freely enter and exit conduit 12 because opening 14 is not obstructed and provides fluid flow there through with little or no resistance.

The lower end of conduit 12 is attached to chamber 18. The opening between conduit 12 and chamber 18 is closed by check valve 20.

Check valve 20 is oriented to allow water to freely flow from conduit 12 into chamber 18. Check valve 20 is, typically, a flexible diaphragm of a resilient material, for example silicon elastomer or the like, which is restrained in such a way that it can selectively flex under slight pressure to allow flow in one direction only. Reverse pressure forces the diaphragm to seal closed. Consequently, check valve 20 will prevent the reverse flow of water from chamber 18 into conduit 12.

Mouthpiece 22, above check valve 20, branches from the side of conduit 12. Mouthpiece 22 opens upward. Mouthpiece 22 is adapted to be held by the mouth of the diver and provides a flow path from conduit 12 to the interior of the mouth. (In the FIGS., the opening of mouthpiece 22 should be considered covered by the diver's mouth.) The intersection of mouthpiece 22 with conduit 12 forms an approximately elliptical opening 24 (as shown best in FIG. 3).

Conduit 12 is configured to approximately match the curvature of the diver's head. The upper portion of conduit 12 curves smoothly to place opening 14 approximately over the center of the head. Alternately, the upper portion of conduit 12 can be straight.

Respiration and purging are facilitated by providing a substantially smooth flow path which is free of abrupt changes in path direction. While not so limited, the curvature may, the example, follow an elliptical path.

Figures 9, 10, 11:
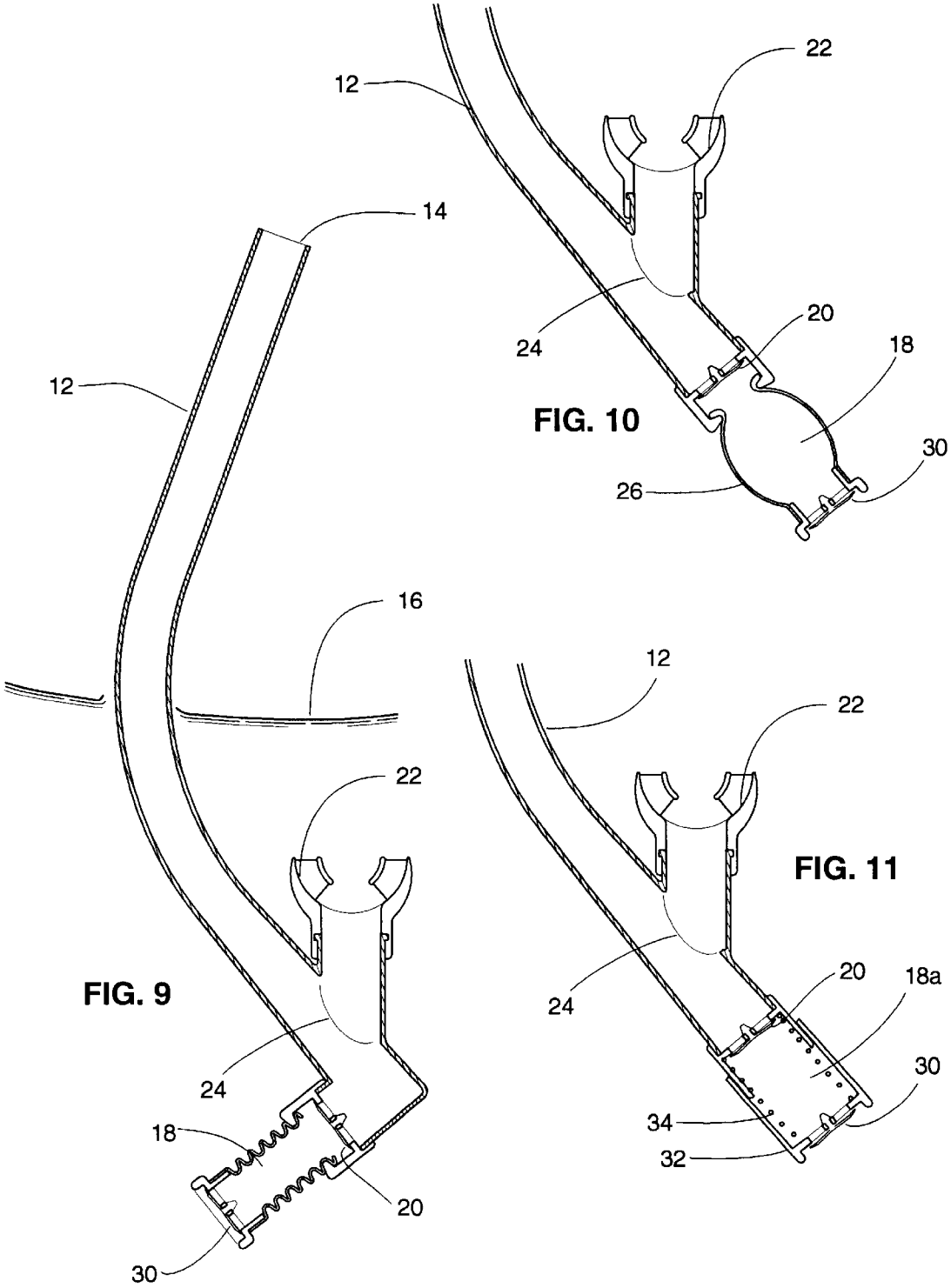
FIG. 9 is a view similar to FIG. 2, showing an alternate configuration.
FIG. 10 is a partial view showing another configuration.
FIG. 11 is a partial view showing yet another configuration.

In one embodiment of the instant invention, wall 26 of chamber 18 is constructed of a resiliently flexible material, for example, molded neoprene rubber. For increased flexibility, wall 26 can incorporate convolutions 28. Alternately, wall 26 can be without convolutions (for example, as shown in FIG. 10). The resiliency of the material serves to force the walls of chamber 18 to return to their original shape or position after being distorted due, for example, to being squeezed by the diver's hand.

Purge valve 30 closes an ambient opening in chamber 18. Purge valve 30 is oriented to allow water to freely flow from chamber 18 to ambient. Purge valve 30 is, typically, a flexible diaphragm of a resilient material, for example silicon elastomer or the like, which is restrained in such a way that it can selectively flex under slight pressure to allow flow in one direction only. Reverse pressure forces the diaphragm to seal closed. Consequently, purge valve 30 will prevent the reverse flow of water from ambient into chamber 18.

Figures 4, 5:
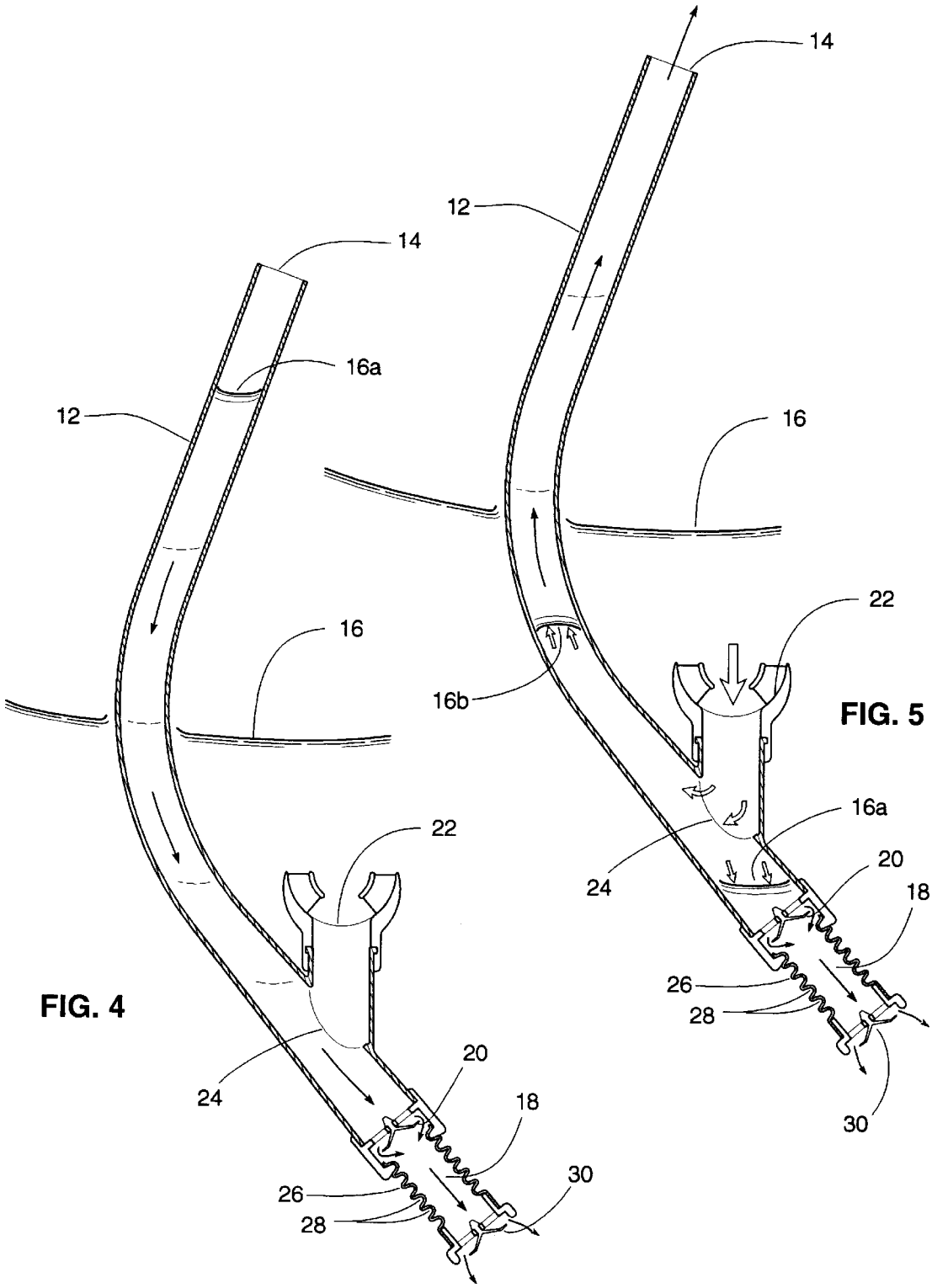
FIG. 4 is a view similar to FIG. 2, showing the snorkel flooded with that portion above the water surface draining to ambient.
FIG. 5 is a view similar to FIG. 2, showing the snorkel during a purging exhalation.

When a skin diver swims or dives below the water surface, water will pour into conduit 12 through opening 14, flooding the snorkel. After the skin diver surfaces and assumes the face down, surface swimming attitude, hydrostatic pressure will cause water (depicted as having surface 16*a* in FIG. 4) within the upper portion of snorkel 10 to flow downward through check valve 20 into chamber 18, increasing the pressure within chamber 18. The increased pressure within chamber 18 will cause the water within chamber 18 to flow through purge valve 30 to ambient. Referring to FIG. 4, the outflow of water (depicted as solid arrows) has flexed both check valve 20 and purge valve 30 outward.

After surface 16*a* drops to the level of ambient surface 16, water remaining in conduit 12 is purged by forcefully exhaling air into mouthpiece 22 (depicted as a large outline arrow in FIG. 5). Referring to FIG. 5, surface tension forms the exhaled air into a bubble having surface 16*b* which expands upward in conduit 12. As the leading surface of the bubble moves away from mouthpiece 22, the bulk of the water within conduit 12 is pushed ahead of the bubble and forced out opening 14 (depicted as solid arrows).

Referring again to FIG. 5, a forceful exhalation will also expand downward against water surface 16*a*. The pressure against surface 16*a* will force the water below mouthpiece 22 to flow sequentially through check valve 20, chamber 18, and purge valve 30. The purging exhalation therefore forces water within conduit 12 to be cleared both above and below mouthpiece 22. As a benefit, the internal volume of chamber 18 and the double valve arrangement provide the transient resistance necessary to allow purging of snorkel conduit 12 before the purging air reaches and is dissipated by the purge valve.

Water which splashes into opening 14, due to swimming movements or wave action or the like, will accumulate in conduit 12 above check valve 20. Similarly, fluids from the mouth, and residual water which adheres to the inner surface of conduit 12 after a purging exhalation, will accumulate above check valve 20 as depicted by surface 16*a* in FIGS. 6, 7 and 8. If chamber 18 is free of water, some of the water accumulating above check valve 20 will flow through check valve 20 into chamber 18. However, ambient hydrostatic pressure against purge valve 30 will prevent continued drainage from chamber 18 to ambient.

Figures 6, 7, 8:
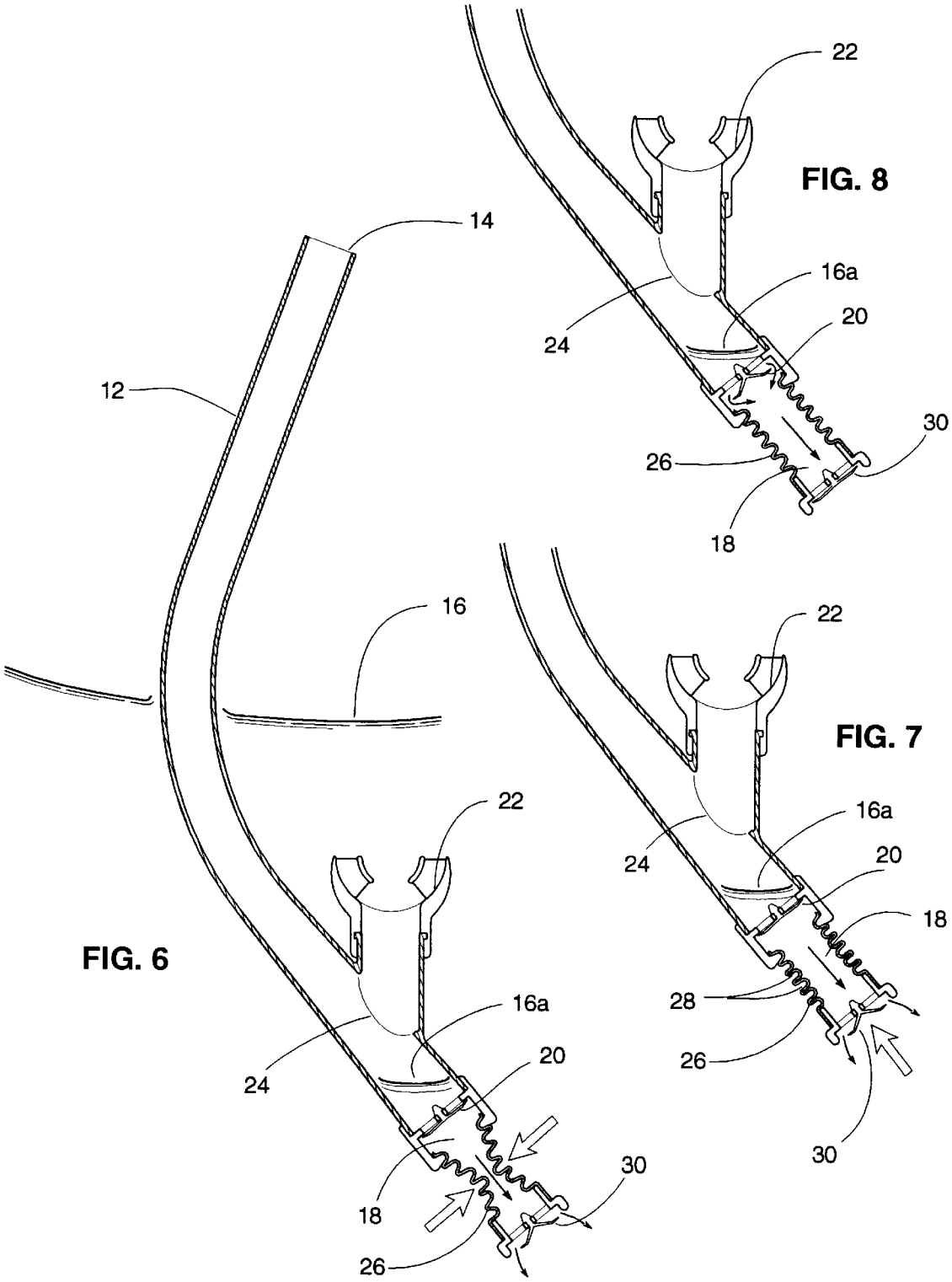
FIG. 6 is a view similar to FIG. 2, showing the snorkel being purged by pumping.
FIG. 7 is a partial view of the snorkel of FIG. 2 showing an alternate pumping action.
FIG. 8 is a partial view of the snorkel of FIG. 2 further showing the pumping action.

The volume of the section of conduit 12 between mouthpiece 22 and check valve 20, combined with the internal volume of chamber 18, is advantageously sized to hold residual water which remains after a purging exhalation and also small amounts of water which occasionally splash into opening 14. Referring to FIGS. 6, 7 and 8, even though some water has accumulated below mouthpiece 20, respiratory flow remains unimpeded. Empirical studies have determined that a combined volume equivalent to ten percent (10%) of the snorkel's total internal volume is sufficient for this purpose.

Referring again to FIG. 6, wall 26 of chamber 18 is shown flexed or pinched inward, thereby reducing the internal volume of chamber 18. Reducing the internal volume of chamber 18 forces at least part of the air or water within chamber 18 to flow out purge valve 30 to ambient. In FIG. 6, the outflow of water (depicted as solid arrows) has flexed purge valve 30 outward. The force (depicted as outline arrows in FIG. 6) which flexes wall 26 inward can be applied by the diver's fingers or hand.

Depicting another way to reduce the internal volume of chamber 18, FIG. 7 shows the internal volume of chamber 18 reduced by forcing convolutions 28 of wall 26 to be collapsed by an axially directed push (depicted as an outline arrow in FIG. 7).

Referring to FIG. 8, when the collapsing force is removed, the resiliency of wall 26 will force chamber 18 to expand back to its original internal volume. The expansion will pull water or air from conduit 12 through check valve 20 into chamber 18. In FIG. 8, the flow of water (depicted as solid arrows) from conduit 12 into chamber 18 has flexed check valve 20 into chamber 18.

By alternately contracting and releasing chamber 18, residual water can be pumped from conduit 12 without the need for a purging exhalation. While not so limited, the pumping force is manually applied by the diver's hand or fingers. Alternately, the pumping force can be generated electro-mechanically by utilizing appropriate batteries, motors and control circuits.

The orientation of chamber 18 can be in any direction relative to conduit 12 or mouthpiece 22. For example, FIG. 9 shows an orientation which is at 90° to the longitudinal axis of conduit 12. Ideally, chamber 18 will be oriented to minimize the frontal area of the snorkel when the diver is swimming through the water.

The size and shape of chamber 18 can be any one of a number of shapes or configurations. For example, FIG. 10 shows chamber 18 as having a bulb-like shape.

Chamber 18 does not need to be fabricated of a flexible material. FIG. 11 shows chamber 18*a* configured as rigid or semi-rigid position 32 having return spring 34. Check valve 20 is housed within a short extension of conduit 12 adjacent mouthpiece opening 24. Purge valve 30 is advantageously mounted on piston 32. Chamber 18*a* is defined by the volume between check valve 20 and purge valve 30.

The configuration of FIG. 11 will require the use of appropriate dynamic seals and movement limiting stops. However, the dynamic seal between piston 32 and the mating surface of conduit 12 does not have to be absolutely water tight. For ease of movement, position 32 can be configured to have a small circumferential clearance with the mating surface of conduit 12. The amount of water leaking past piston 32 will be relatively insignificant when compared to the amount of water pumped by the movement of piston 32. Furthermore, ambient water which leaks past piston 32 into chamber 18*a* will be prevented from entering conduit 12 by check valve 20.

Figure 12:
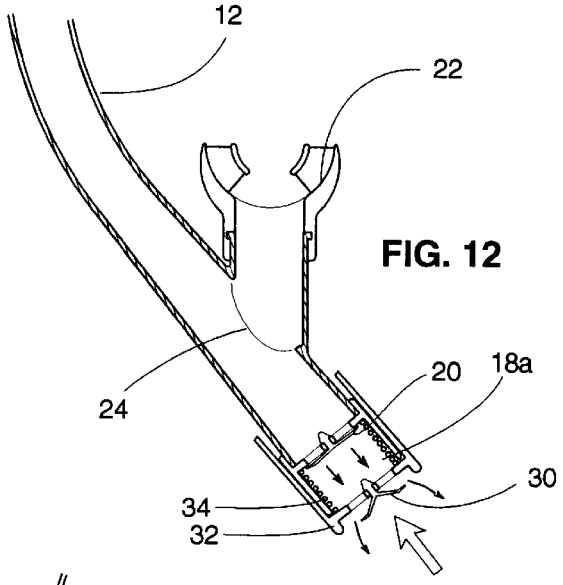
FIG. 12 is a partial view of the snorkel of FIG. 11, showing the snorkel being purged by pumping.

Referring to FIG. 12, the internal volume of chamber 18*a* has been reduced by the inward axial movement of piston 32. As a consequence of the inward axial movement of position 32, spring 34 is compressed. The compressing force (depicted as an outline arrow in FIG. 12) which moves piston 32 inward is typically applied by the diver's fingers or hand.

When the compressing force is removed, spring 34 will force piston 32 outward, thereby re-expanding chamber 18*a* to its original internal volume. Similar to the action depicted by FIG. 8, as chamber 18*a* re-expands, water or air will be pulled from conduit 12 through check valve 20 into chamber 18*a*. The alternating reduction and recovery of the internal volume of chamber 18*a* produces a pumping action which removes water from the interior of conduit 12.

Figure 13:
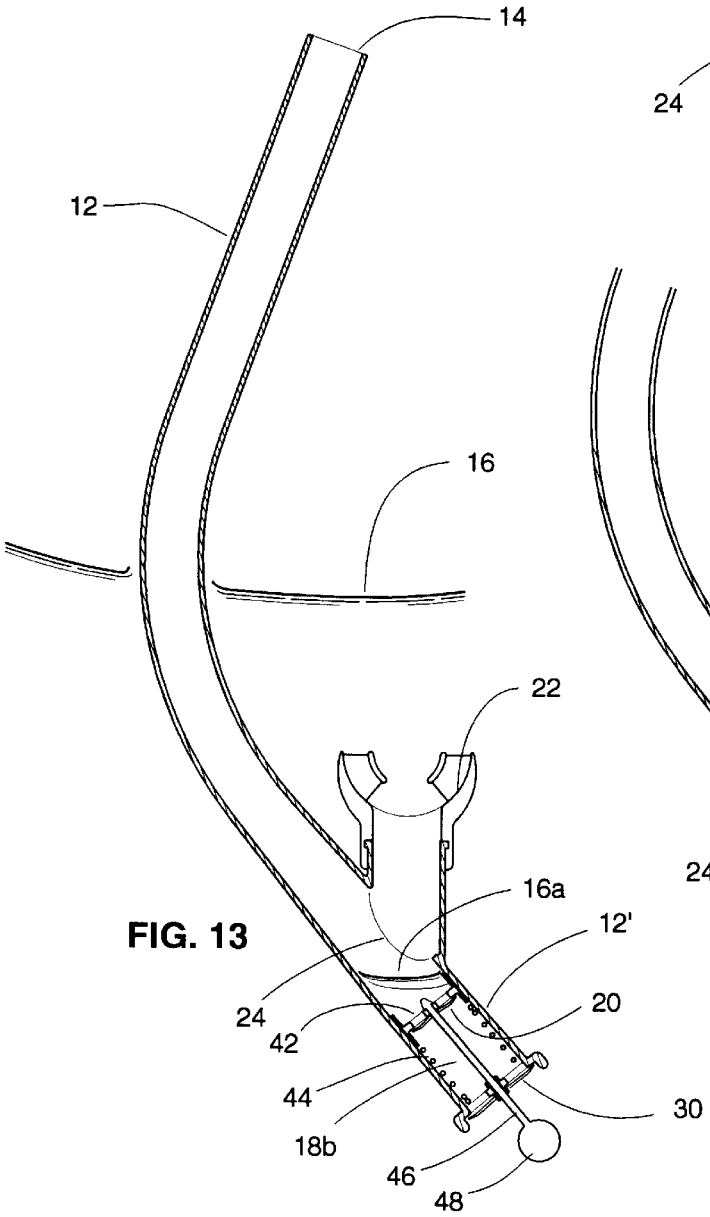
FIG. 13 is a view similar to FIG. 2, showing yet another alternate configuration.
Figure 14:
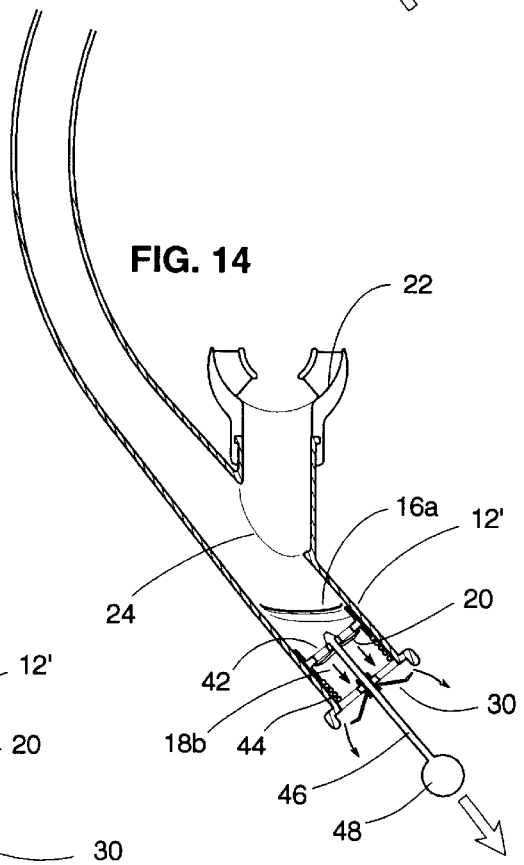
FIG. 14 is a partial view of the snorkel of FIG. 13, showing the snorkel being purged by pumping.

FIGS. 13 and 14 show the preferred configuration. The inventive snorkel configuration of FIG. 13 incorporates internal piston 42 and associated spring 44 housed within rigid or semi-rigid extension 12' of conduit 12. As shown in FIG. 13, spring 44 is a compression spring located within chamber 18*b*. Alternately, spring 44 can be a tension spring attached at one end to the conduit side of piston 42, and having the other end appropriately anchored to the inside wall of conduit 12. Whether compression or tension, spring 44 serves to provide the force which selectively returns piston 42 to the position which provides the maximum volume of chamber 18*b*.

For the configuration of FIG. 13, check valve 20 is advantageously mounted on, and carried by, piston 42. Purge valve 30 is mounted to cover the end of extension 12'. Chamber 18*b* is defined by the volume between check valve 20 and purge valve 30.

The configuration of FIG. 13 requires the use of appropriate dynamic seals and movement limiting stops. However, the dynamic seal between piston 42 and the inside mating surface of extension 12' does not have to be absolutely water tight. For ease of movement, piston 42 can be configured to have a small circumferential clearance with the mating inside surface of extension 12'. The amount of water leaking past piston 42 will be relatively insignificant compared to the amount of water pumped by the movement of piston 42. Furthermore, purge valve 30 will prevent ambient water from entering chamber 18*b* and subsequently flowing into conduit 12.

Movement of piston 42 is facilitated by pull-rod 46. Knob 48, on the end of pull-rod 46, provides a firm place for the fingers to grip when pulling pull-rod 46. Alternately, pull-rod 46 can be a flexible cable, or the like, and knob 48 can be a ring, or the like. The pulling force is depicted as an outline arrow in FIG. 14.

Referring to FIG. 14, pull rod 46 has been pulled outward thereby moving piston 42 and check valve 20 toward purge valve 30. Consequently, the internal volume of chamber 18*b* is reduced and spring 44 is compressed. When the pulling force is removed, spring 44 will force piston 42 upward, thereby re-expanding chamber 18*b* to its original internal volume. Similar to the action described supra, alternately pulling and releasing pull rod 46 produces a pumping action which removes water from the interior of conduit 12.

Other variations on the diameter, cross-section shape and radius of curvature of the conduit; various splash blocking structures and coverings of opening 14; various shapes and configurations of chamber 18, the use of multiple chambers, and various methods to adjust the mouthpiece or chamber location relative to the conduit, are contemplated. It is understood that those skilled in the art may conceive of modifications and/or changes to the invention described above. Any such modifications or changes which fall within the purview of the description are intended to be included therein as well. This description is intended to be illustrative and is not intended to be limitative. The scope of the invention is limited only by the scope of the claims appended hereto.

I claim:

1. A snorkel device comprising:

a conduit having first and second open ends thereof;

said conduit first open end adapted to admit ambient fluid into said conduit;

mouthpiece joined to said conduit between said first and second open ends for communicating fluid flow with said conduit;

pump connected to said conduit second open end, said pump arranged to selectively provide unidirectional flow of fluid from said conduit for evacuating fluid from said conduit;

said pump comprising a unitary chamber having walls with first and second openings thereof;

said chamber first opening joined to communicate fluid flow with said conduit second open end;

purge valve adjacent said chamber second opening, said purge valve arranged to selectively provide unidirectional flow from said chamber to ambient;

piston situated within said chamber, said piston slidablely engaged with said chamber walls, said piston capable of reciprocating motion between said chamber first and second openings;

said piston incorporates a check valve, said check valve arranged to selectively provide unidirectional fluid flow from said conduit to said chamber;

forcing means associated with said piston to selectively position said piston adjacent said chamber first opening; and control means attached to said piston to allow the user to selectively counter said forcing means for expelling fluid to ambient through said purge valve.

2. The snorkel device recited in claim 1 wherein:

said forcing means is a spring.

3. The snorkel device recited in claim 1 wherein:

said control means is manually operated.

4. The control means recited in claim 3 wherein:

said control means is a pull-rod.

* * * * *